US007475711B2

(12) United States Patent
Fawcett, Jr. et al.

(10) Patent No.: US 7,475,711 B2
(45) Date of Patent: Jan. 13, 2009

(54) HEAT SEALABLE INFLATOR

(75) Inventors: Lyman W. Fawcett, Jr., St. Petersburg, FL (US); Gregory Jordan, Palm Harbor, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 33 days.

(21) Appl. No.: 11/435,106

(22) Filed: May 16, 2006

(65) Prior Publication Data

US 2007/0277903 A1 Dec. 6, 2007

(51) Int. Cl.
*B67C 3/00* (2006.01)
*B67D 5/00* (2006.01)

(52) U.S. Cl. ..... 141/329; 141/3; 141/19; 222/5; 441/94

(58) Field of Classification Search ..... 141/3, 141/19, 329, 330; 222/5; 441/92–95
See application file for complete search history.

(56) References Cited

U.S. PATENT DOCUMENTS

| | | | | |
|---|---|---|---|---|
| 3,059,814 | A | 10/1962 | Pnocel et al. | |
| 3,091,782 | A | 6/1963 | Scalfani | |
| 3,426,942 | A | 2/1969 | McMains et al. | |
| 3,579,964 | A | 5/1971 | Ohlstein | |
| 3,702,014 | A | 11/1972 | Rabon et al. | |
| 3,754,731 | A | 8/1973 | Mackal et al. | |
| 3,757,371 | A | 9/1973 | Martin | |
| 3,809,288 | A | 5/1974 | Mackal | |
| 3,910,457 | A | 10/1975 | Sutliff | |
| 3,997,079 | A | 12/1976 | Niemann | |
| 4,216,182 | A | 8/1980 | Mackal et al. | |
| 4,223,805 | A | 9/1980 | Mackal | |
| 4,260,075 | A | 4/1981 | Mackal | |
| 4,267,944 | A | 5/1981 | Mackal | |
| 4,382,231 | A | 5/1983 | Miller | |
| 4,436,159 | A | 3/1984 | Revay | |
| 4,513,248 | A | 4/1985 | Miller | |
| 4,627,823 | A | 12/1986 | Mackal | |
| 4,894,036 | A | 1/1990 | Switlik | |
| 5,058,932 | A | 10/1991 | Mackal | |
| 5,058,933 | A | 10/1991 | Mackal | |
| 5,076,468 | A | 12/1991 | Mackal | |
| 5,080,402 | A | 1/1992 | Mackal | |
| 5,271,525 | A * | 12/1993 | Petrie | 222/5 |
| 5,564,478 | A | 10/1996 | Weinheimer et al. | |
| 6,589,087 | B2 * | 7/2003 | Mackal et al. | 441/93 |
| 6,705,488 | B2 * | 3/2004 | Mackal et al. | 222/5 |

* cited by examiner

*Primary Examiner*—Timothy L Maust
(74) *Attorney, Agent, or Firm*—Holland & Knight

(57) ABSTRACT

An inflator comprising a housing having an integrally formed mounting flange adapted to be heat-sealed directly to an inflatable article. A sleeve is injection molded in-situ inside the housing in which a pierce pin assembly is reciprocatably mounted within a central bore thereof. The sleeve within the housing allows the wall thickness of the housing to be significantly reduced and assures that the escaping gas from the cylinder always contacts the housing material. The sleeve includes a skirt extension with a socket defining the blind hole for receiving the end of the pivot pin of the firing lever to allow the injection-molding of a blind hole for the pivot pin without the need for subsequent drilling of the hole.

20 Claims, 20 Drawing Sheets

FIG 11C
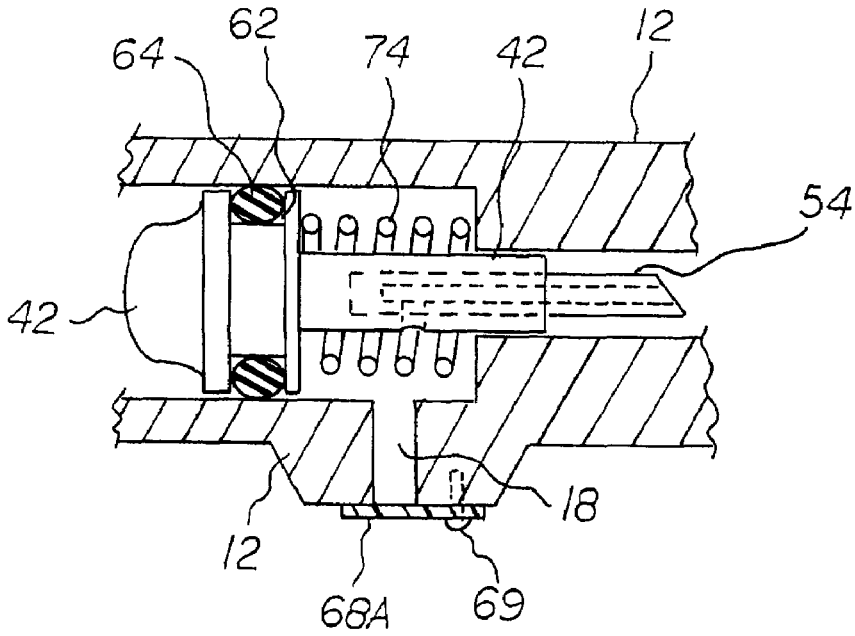
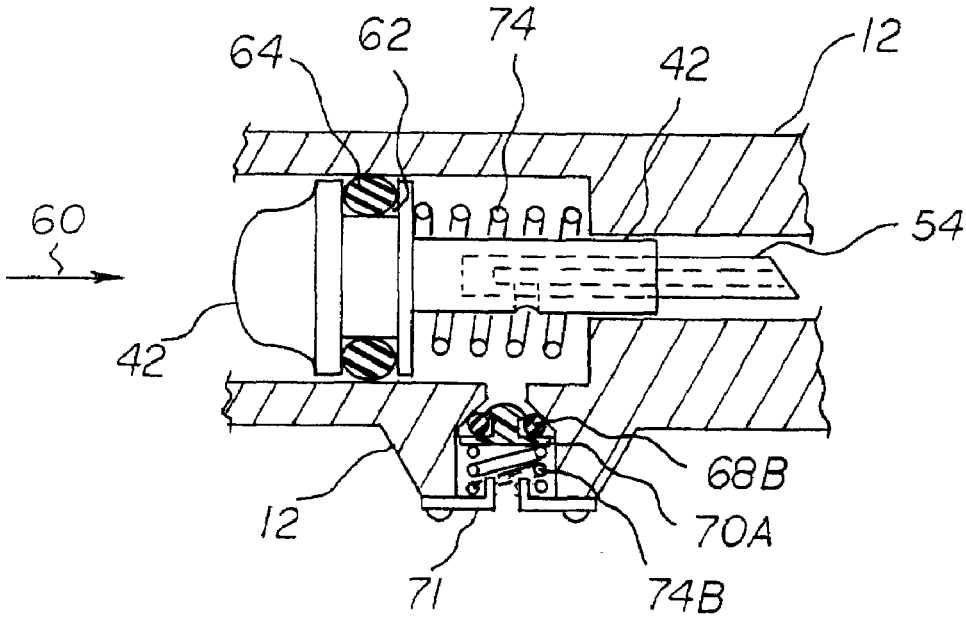
FIG 11D

HEAT SEALABLE INFLATOR

BACKGROUND OF THE INVENTION

1. Field of the Invention

This invention relates to an inflator for inflating articles such as personal floatation devices, rafts, buoys, and emergency signaling equipment. More particularly, this invention relates to inflators whose housings may be directly heat-sealed to the inflatable article while assuring that the inflatable article remains inflated even when the gas cartridge of the inflator is removed.

2. Description of the Background Art

Presently, there exist many types of inflators designed to inflate inflatable articles such as personal floatation devices (life vests, rings and horseshoes), life rafts, buoys and emergency signaling equipment. Inflators typically comprise a body for receiving the neck of a cartridge of compressed gas such as carbon dioxide. A reciprocating pierce pin is disposed within the body of the inflator for piercing frangible seal of the cartridge to permit compressed gas therein to flow into a manifold assembly of the inflator and then into the article to be inflated. Typically, a manually movable firing lever is operatively connected to the piercing pin such that the piercing pin pierces the frangible seal of the cartridge upon jerking of a ball lanyard. U.S. Pat. No. 3,809,288, the disclosure of which is hereby incorporated by reference herein, illustrates one particular embodiment of a manual inflator.

Water-activated actuators have been incorporated into manual inflators so that in an emergency situation such as downed aviator, injured person or a man overboard, the inflator is automatically actuated to inflate the inflatable article to which it is connected. Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, and 5,076,468, the disclosures of which are hereby incorporated by reference herein.

As disclosed in the above-referenced patents, inflators, whether manually or water-activated, are typically connected to the inflatable article by means of the manifold assembly that consists of a metal manifold having a lower flange which is molded in situ with a rubber flange to establish a flow path between the flange and the metal manifold. A one-way valve, such as a schraeder valve, is installed in the manifold. During installation, a hole is formed in the inflatable article and the manifold is positioned therethrough. The flange of the manifold assembly is then heat-sealed to the wall of the inflatable article. Notably, the one-way valve in the manifold permits inflation of the inflatable article while precluding deflation once inflated. Representative patents relating to manifold assemblies are U.S. Pat. Nos. 5,080,402, 5,058,933, 5,058,932, 4,216,182, 3,809,288 and 3,754,731, the disclosures of which are hereby incorporated by reference herein.

Correspondingly, typical inflators comprise a manifold hole which is configured and dimensioned to receive the manifold of the manifold assembly. A locking nut is threaded onto the end of the manifold to secure the inflator. An O-ring seal is provided to prevent leakage between the manifold and the inflator.

During use, upon firing of the inflator, either manually or automatically, gas from the compressed gas cartridge flows into the manifold hole of the inflator and then into the manifold. The gas then flows past the one-way valve in the manifold and into the inflatable article. Since the one-way valve of the manifold assembly precludes deflation of the inflatable article, the gas cartridge may be removed from the inflator and the inflatable article will remain inflated.

While manifold assemblies have been in extensive use in the industry for many years, they are relatively expensive to manufacture and require additional assembly operations. Accordingly, there existed a need in the inflator industry for an inflator which may be heat-sealed directly to the inflatable article thereby obviating the need for manifold assemblies and the like.

U.S. Pat. No. 4,894,036, the disclosure of which is hereby. incorporated by reference herein, discloses an inflator which may be heat-sealed directly to an inflatable article thereby obviating the need for manifold assemblies and the like. The heat-sealable inflator as shown in such patent includes a mounting flange integrally formed about the housing of the inflator. The housing together with the integral mounting flange are composed of a plastic or similar material which may be heat-sealed to inflatable articles composed of conventional plastic or other materials. The housing includes a reciprocal pierce pin and a firing lever. A pair of compression springs are provided at opposing ends of the pierce pin to exert forces thereon in opposite directions. A pair of O-rings is also provided at opposing ends of the pierce pin. During firing upon jerking of the manual firing lever, the cammed end thereof exerts a force on the rearward (stronger) spring and causes the pierce pin to move forwardly and pierce the gas cartridge. The cammed end of the manual firing lever is configured such that upon further movement of the lever, the pierce pin may be blown-back fully rearwardly by means of the forward (weaker) compression spring combined with the pressure exerted by the gas from the gas cartridge. The bore of the housing in which the pierce pin is reciprocatably positioned is configured in such a manner that when the pierce pin is blown-back fully rearwardly, the gas may flow through a port into the inflatable article. However, once the gas has escaped from the gas cartridge into the inflatable article, the lost pressure allows the rearward (stronger) spring to return the pierce pin assembly to its rest position. The bore of the housing is configured so that when the pierce pin is in its rest position, the O-rings seal the port both forwardly and rearwardly in the bore thereby precluding the gas from the inflatable article from escaping.

Unfortunately, the specific design of the heat-sealable inflator as shown in U.S. Pat. No. 4,894,036 is expensive to manufacture due to the necessity of dual springs and its other components. Moreover, it appears that the specific design could undesirably prevent inflation if the firing lever was only moved partially through its path of travel (see FIG. 5 thereof).

U.S. Pat. No. 5,564,478, the disclosure of which is hereby incorporated by reference herein discloses an improved heat sealable inflator having a design that is significantly easier to manufacture and less costly. The heat sealable inflator as disclosed in U.S. Pat. No. 5,564,478 comprises a housing with an integrally formed mounting flange that is injected molded. A pierce pin assembly is then assembled within a bore in the housing. A firing lever is then pivotally connected to the pierce pin assembly such that upon actuation of the firing lever, the pierce pin assembly is actuated to pierce the frangible seal of a gas cartridge threaded therein, thereby allowing inflation of the article to which the inflator is heat sealed. Unfortunately, however, the inflator of U.S. Pat. No. 5,564,478 requires thick wall sections for a metal thread insert that threadably receives the gas cartridge, thereby increasing cycle times and costs during injection molding. Moreover, the escaping gas contacts the heat sealable material along with the metal components of the pierce pin assembly, which could lead to leaks to the outside if adequate sealing adhesion is not attained between such components. Moreover, the pivot pin on which the firing lever pivots is installed through a hole that must be drilled through the housing. Since the main bore core pin, during injection, has water running through it, thereby precluding the possibility of positioning a pin for the pivot hole through the core pin. It is noted that the running water through the main bore core pin is required to maintain the type of tolerances required by the O-ring that seals the bore in the assembly. Accordingly, there presently exists a need for a more easily manufacturable and assemblable heat sealable inflator that allows thinner wall sections and obviates the need for manual drilling of the hole for the pivot pin of the firing lever.

Therefore, it is an object of this invention to provide an improvement which overcomes the aforementioned inadequacies of the prior art devices and provides an improvement which is a significant contribution to the advancement of the inflation art.

Another object of this invention is to provide a heat-sealable inflator for inflatable articles having a housing with a mounting flange integral thereto, the housing and the flange being composed of a material that is capable of being easily sealed to the type of materials that are typically utilized in the construction of inflatable articles.

Another object of this invention is to provide a heat-sealable inflator which utilizes a minimal number of components and is therefore economical to manufacture.

Another object of this invention is to provide a heat-sealable inflator having a design which precludes deflation of the inflatable article once inflated even if the gas cartridge threaded into the housing is removed.

Another object of this invention is to provide a heat-sealable inflator having a design which eliminates a condition of non-inflation even if the firing lever thereof does not move through its full path of travel.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an inflator adapted to be heat-sealed directly to an inflatable article thereby obviating the need for inflation manifolds and the like. More particularly, the inflator of the invention comprises a housing having an integrally formed mounting flange. A pierce pin assembly is reciprocatably mounted within a central bore of the housing. Importantly, a sleeve is injection molded in-situ inside the housing in either an insert-molded or a two-shot molding process.

The utilization of a sleeve within the housing allows the wall thickness of the housing to be significantly reduced, thereby significantly minimizing cycle times and costs during the injection molding process. Moreover, the molding of the sleeve in-situ inside the housing assures that the escaping gas from the cylinder always contacts the housing material. The likelihood of leaks which may otherwise occur because of the lack of adequate sealing adhesion during molding between the housing material and the sleeve is essentially eliminated due to the escaping gas always contacting the housing material.

Another significant aspect of the heat sealable inflator of the invention is the incorporation of a blind hole for the pivot pin of the firing lever in the inflator body without the need for drilling the hole as is common in my prior patent, U.S. Pat. No. 5,564,478. More particularly, in this invention, the blind hole formed in the inflator housing is created by first injection molding the sleeve having a skirt extension formed with a socket defining the blind hole for receiving the end of the pivot pin. The blind hole of the socket is blocked-off during the molding of the housing around the cylinder in such a way that the plastic does not fill the hole. A more complete description of this molding process is described in our concurrently-filed patent application entitled "Two-Shot Injection Molding Manufacturing Apparatus and Method", the disclosure of which is hereby incorporated by reference herein.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 11C is a partial cross-sectional of the inflator of the invention employing an alternative embodiment of a check valve to prevent an inflated inflatable from deflating in the event the gas cartridge is removed;

FIG. 11D is a partial cross-sectional of the inflator of the invention employing another alternative embodiment of a check valve to prevent an inflated inflatable from deflating in the event the gas cartridge is removed;

Similar reference characters refer to similar parts throughout the several views of the drawings.

DETAILED DESCRIPTION OF THE PREFERRED EMBODIMENT

Referring to FIGS. 1-7, the heat sealable inflator 10 of the invention comprises a generally rectangular housing 12 having an integral peripheral flange 14. The material constituting the housing 12 with its flange 14 is composed of a heat sealable material such as polyurethane that may be heat sealed to conventional inflatable articles such as personal floatation devices, life rafts, and the like (not shown). Characteristically, the material constituting the housing 12 and its integral flange 14 is of a generally softer material having a hardness in the range of 40 to 90 on the durometer scale Shore D and a tensile strength of about 5800 psi.

Figure 1:
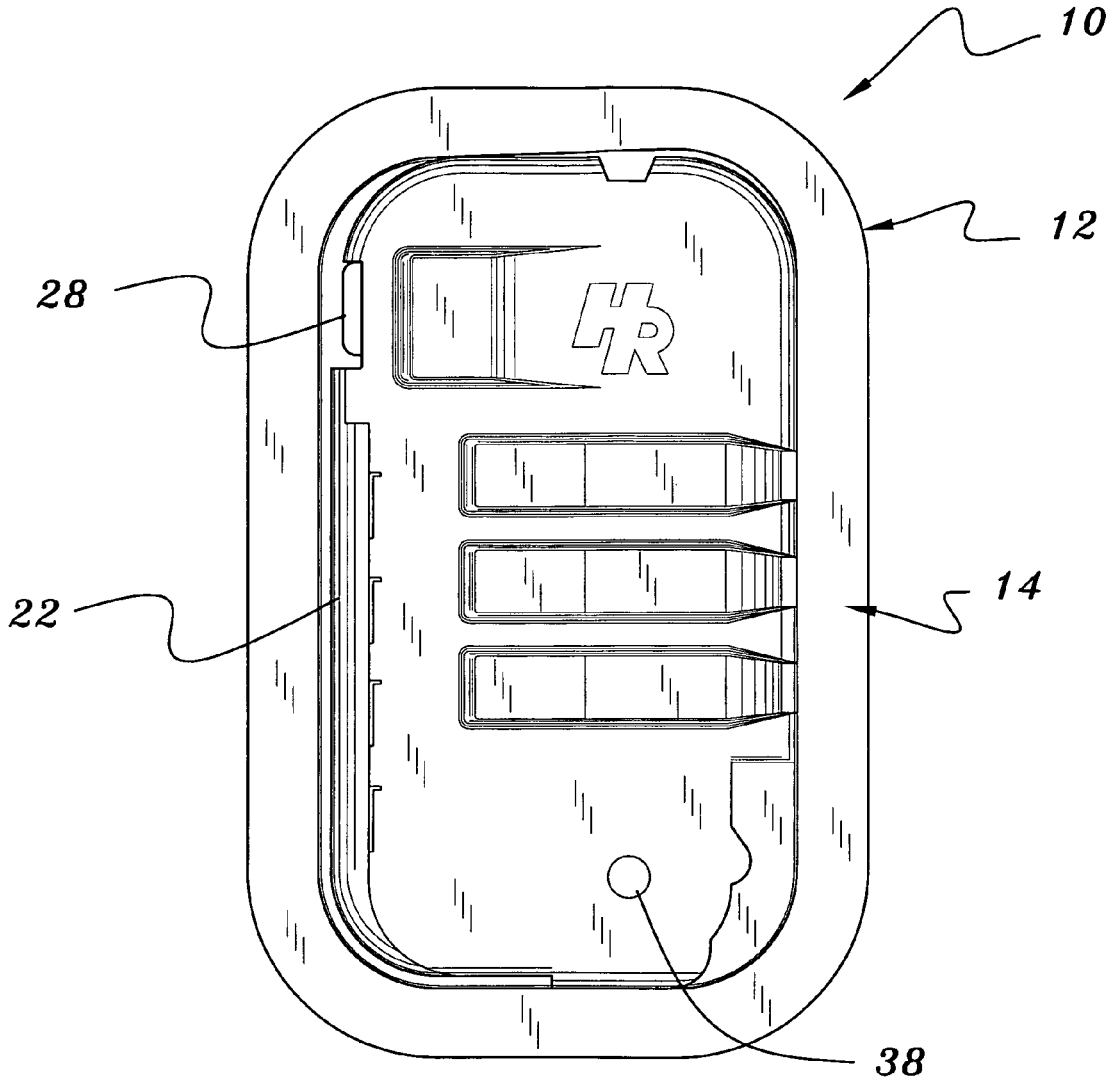
FIG. 1 is a front view of the inflator of the invention.
Figure 2:
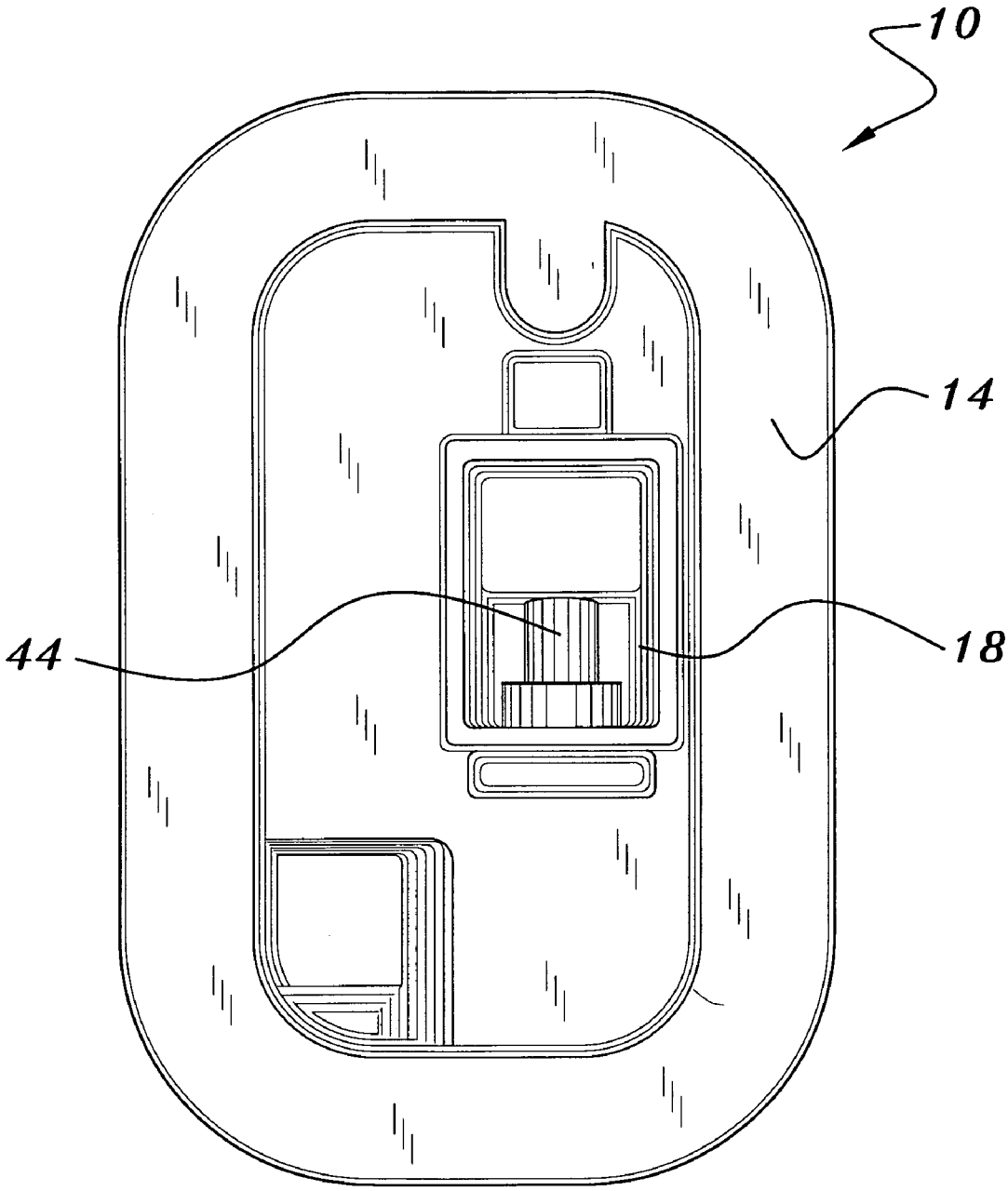
FIG. 2 is a rear view thereof.
Figure 3:
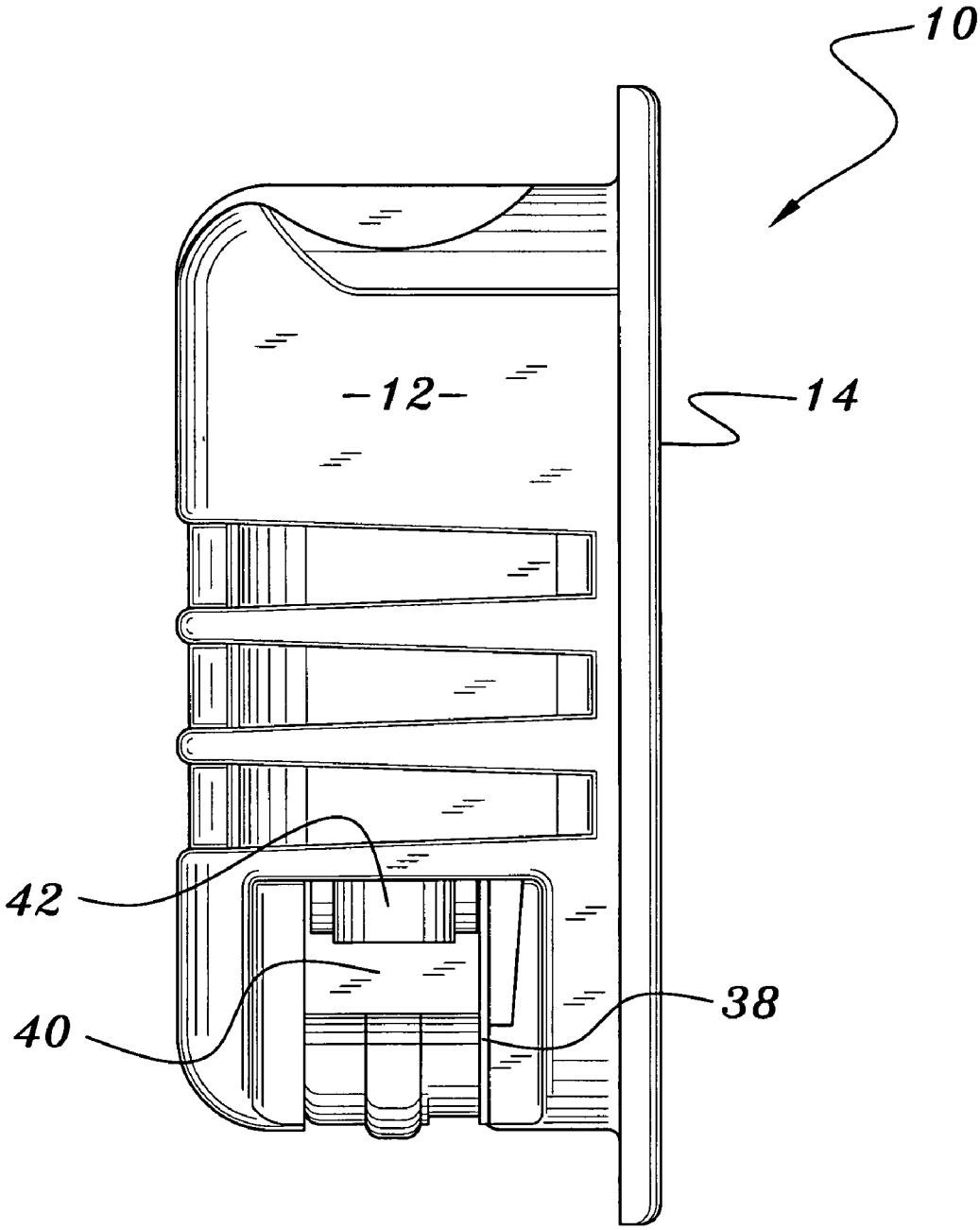
FIG. 3 is a right side view thereof.
Figure 4:
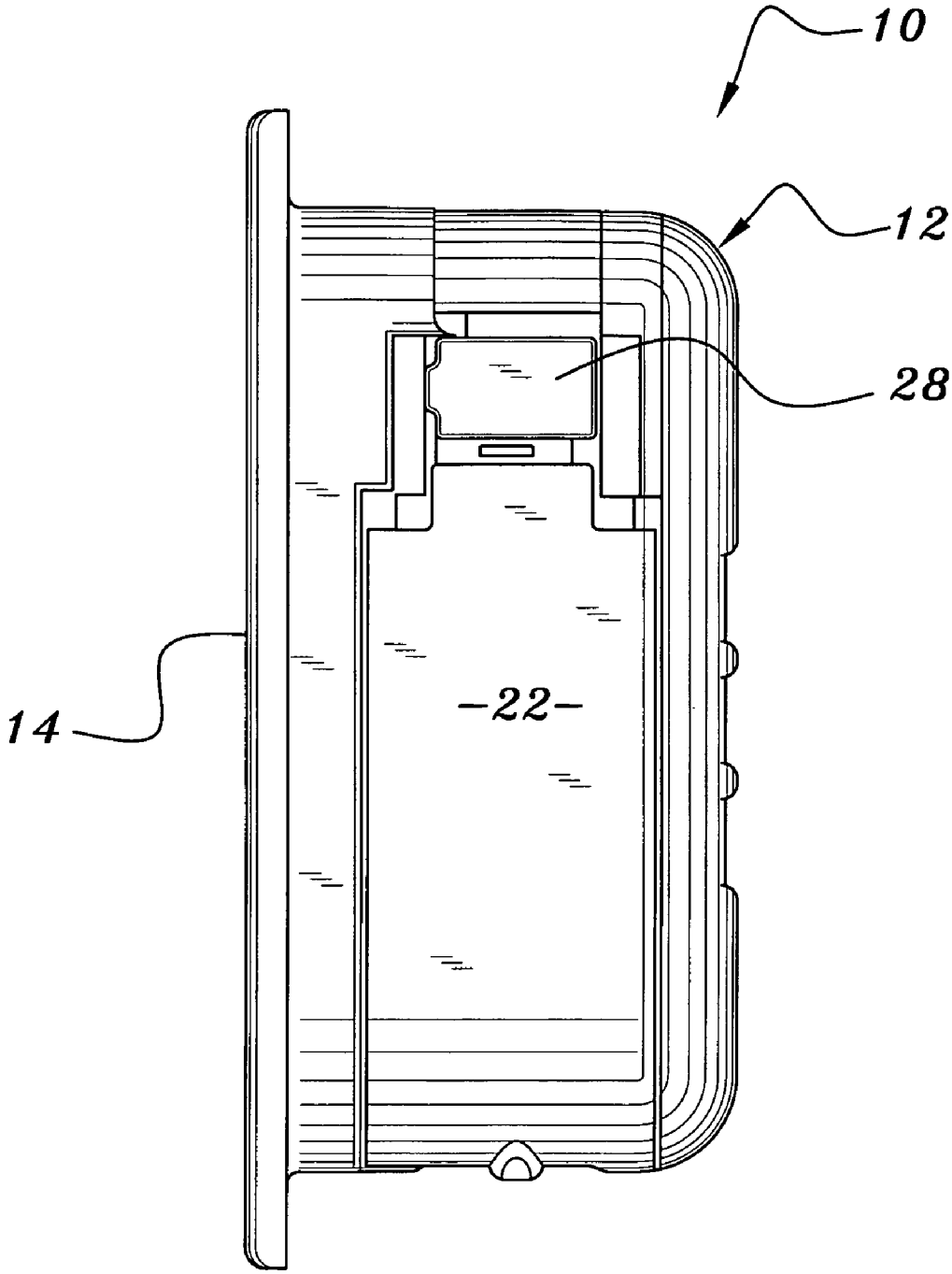
FIG. 4 is a left side view thereof.
Figure 5:
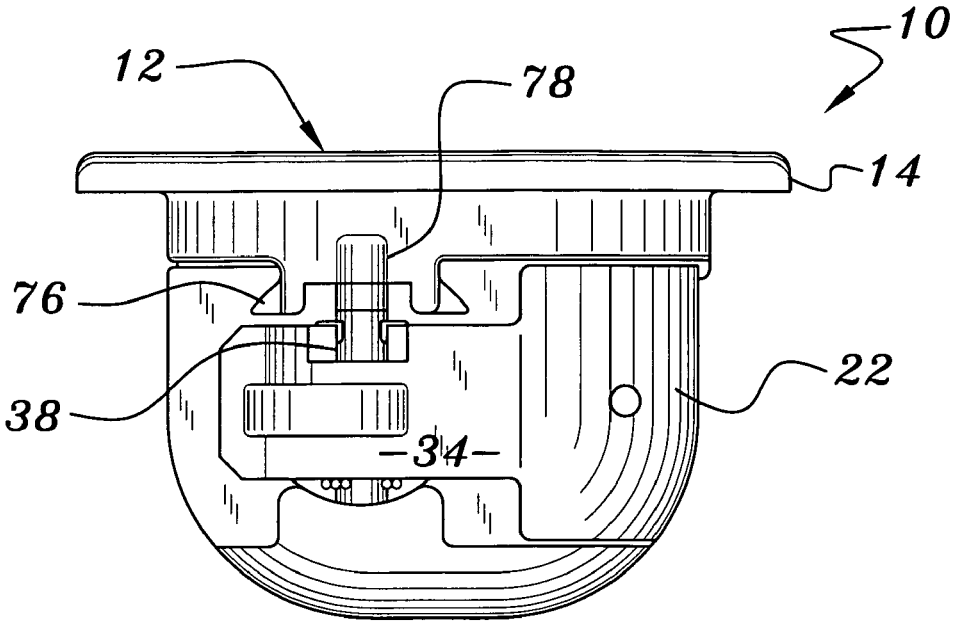
FIG. 5 is bottom view thereof.
Figure 6:
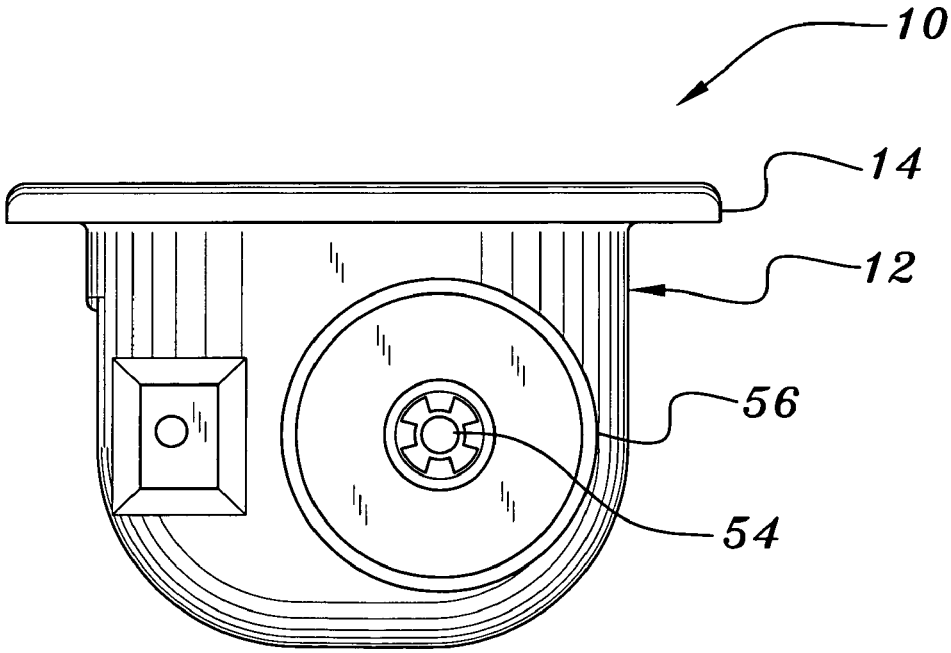
FIG. 6 is a top view thereof.

As best shown in FIG. 2, formed in the rear surface 16 of the inflator housing 12 is an exhaust port 18 which provides fluid communication from the inflator 10 into the inflatable article (not shown).

Figure 7:
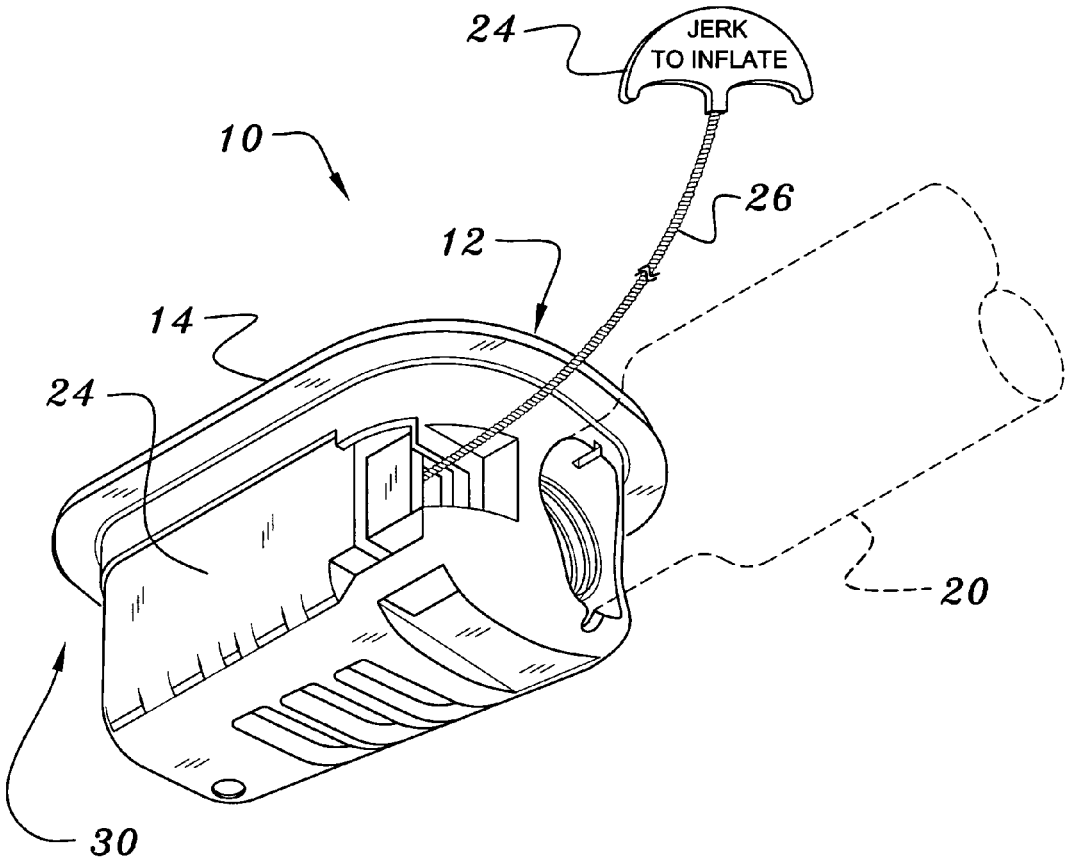
FIG. 7 is a perspective view thereof.

As best shown in FIG. 7, the inflator 10 is adapted to receive the threaded neck of a gas cylinder (shown in phantom as numeral 20) such that upon release of the gas therefrom, the gas may flow through the inflator 10 and then out the exhaust port 18 (see FIG. 2) into the inflatable article (not shown).

As shown in FIG. 7, the inflator 10 comprises a firing lever 22 to which is tethered a jerk handle 24 by means of a braided lanyard 26. A removable safety clip 28 is provided for retaining the firing lever 22 into its normal unfired position substantially flush with the left side 30 of the inflator (see FIGS. 5 and 6) such that the firing lever 22 does not protrude therefrom and otherwise be inadvertently caught or snagged.

Figure 8A:
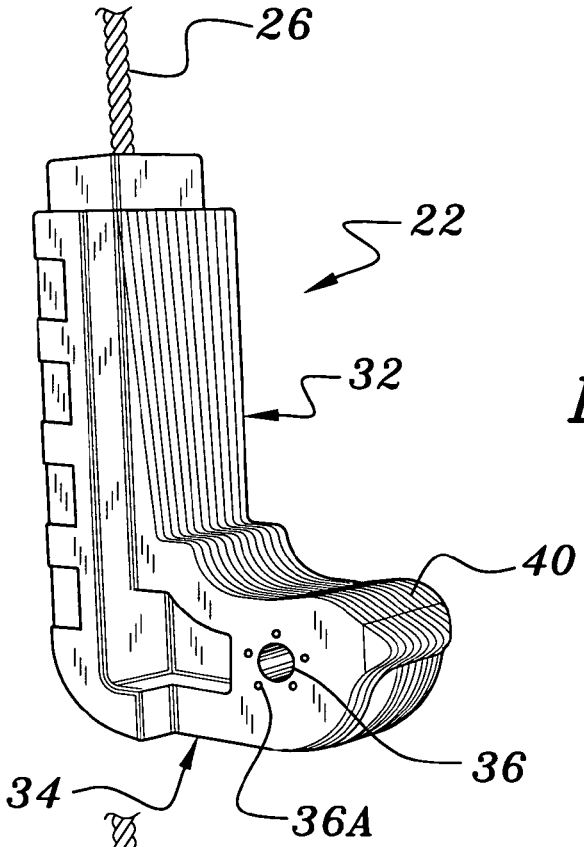
FIG. 8A is a perspective view of the firing lever incorporated into the inflator of the invention.
Figure 8B:
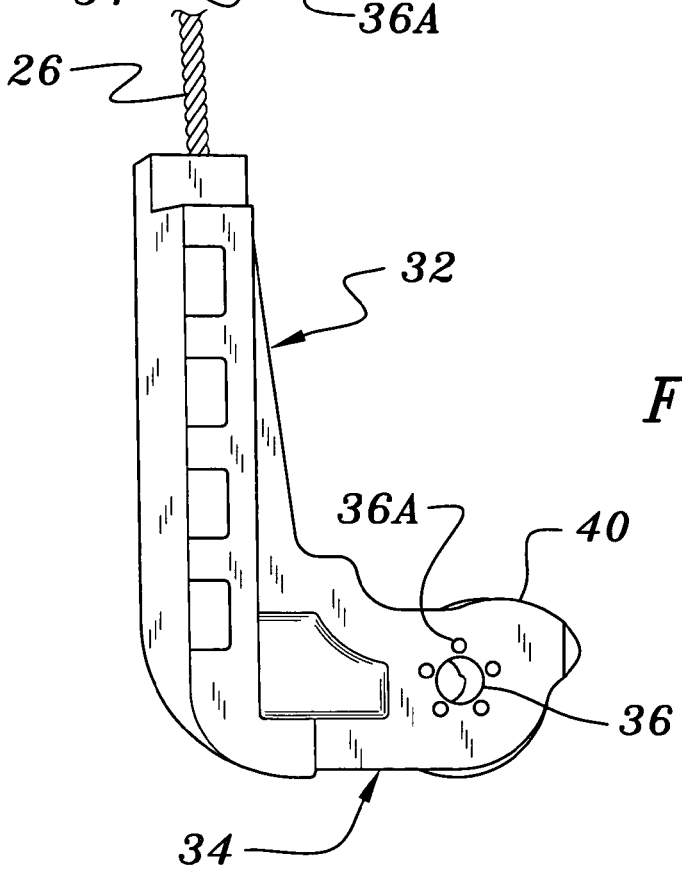
FIG. 8B is a front view thereof.
Figure 8C:
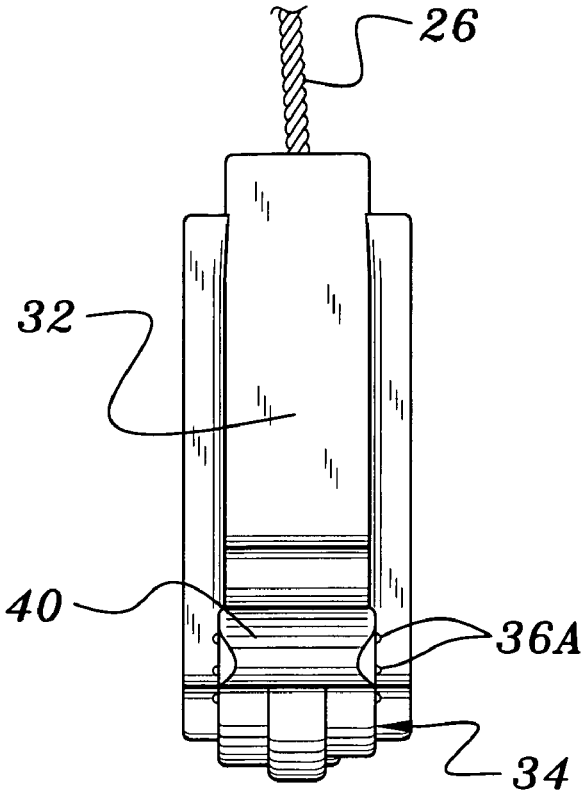
FIG. 8C is a right side view thereof.
Figure 9A:
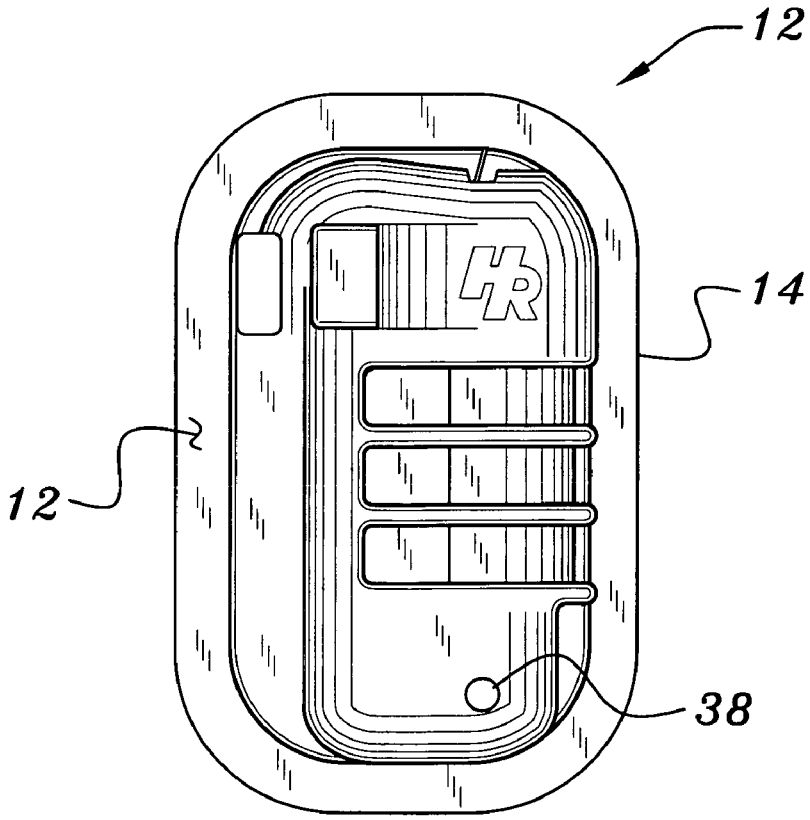
FIG. 9A is a front view of the housing of the inflator of the invention with all other components removed.
Figure 9B:
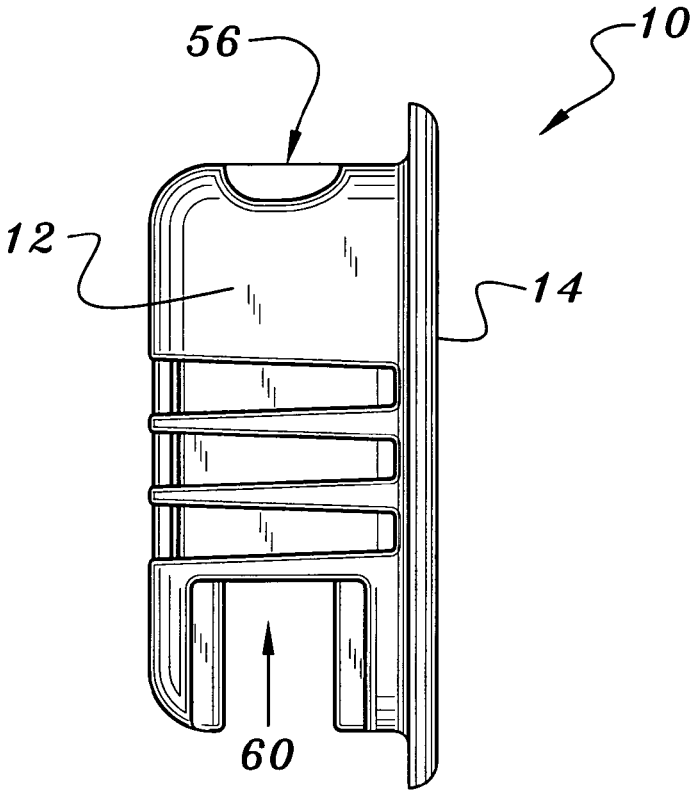
FIG. 9B is a right side view thereof.
Figure 9C:
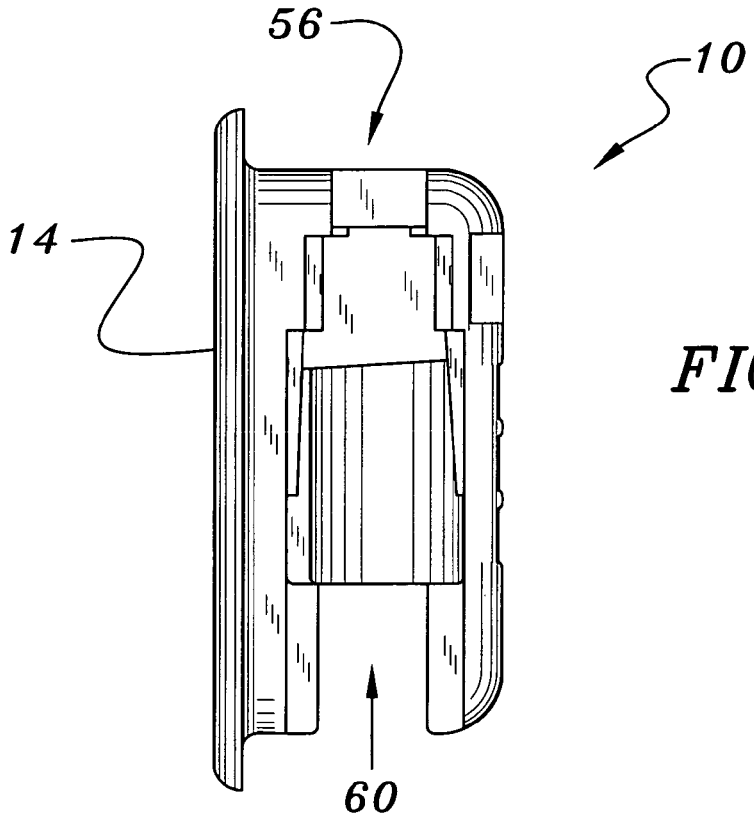
FIG. 9C is a left side view thereof.
Figure 9D:
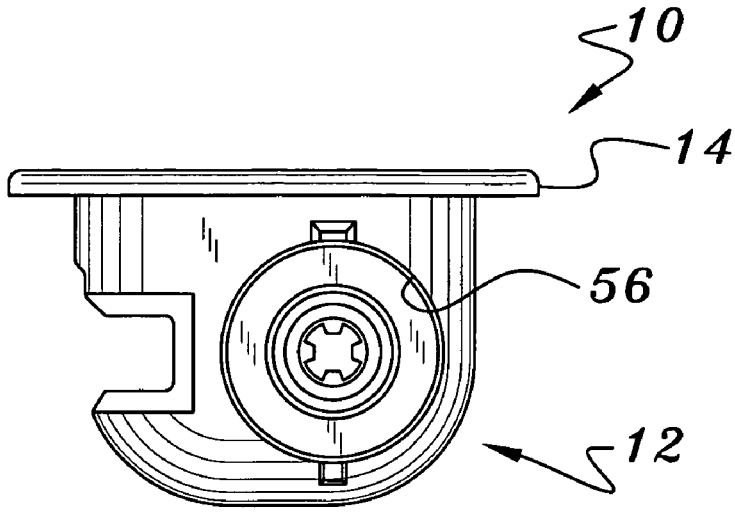
FIG. 9D is a top view thereof.
Figure 9E:
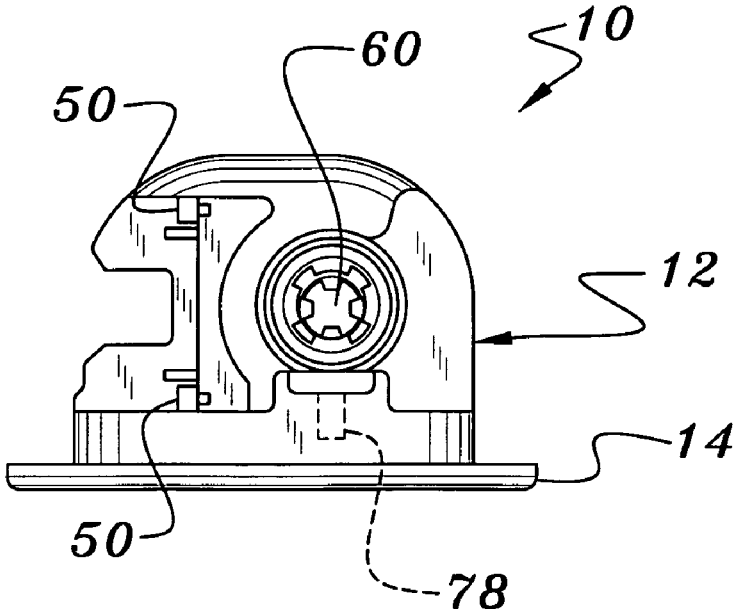
FIG. 9E is a bottom view thereof.
Figure 10A:
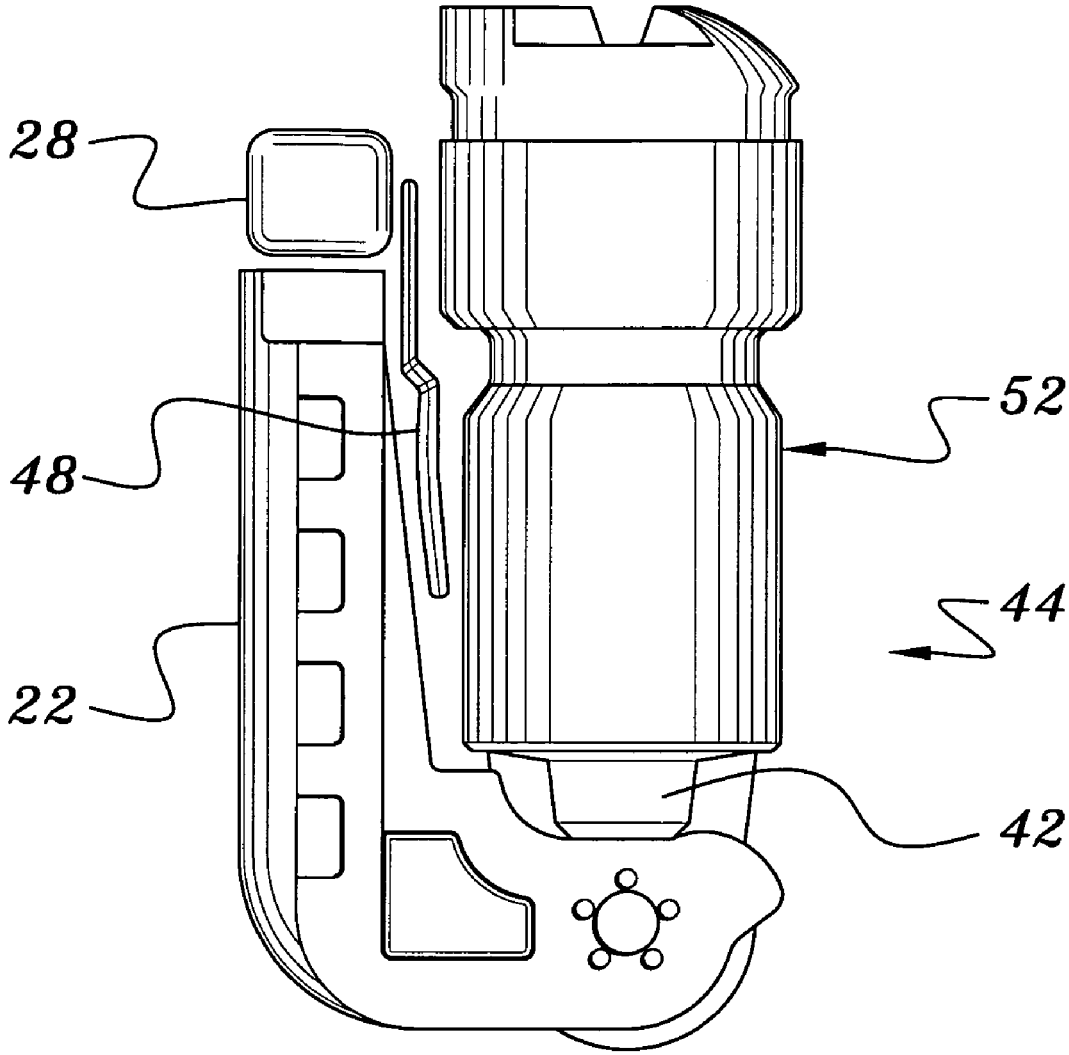
FIG. 10A is a front view of the operative components of the inflator of the invention with the housing omitted.
Figure 10B:
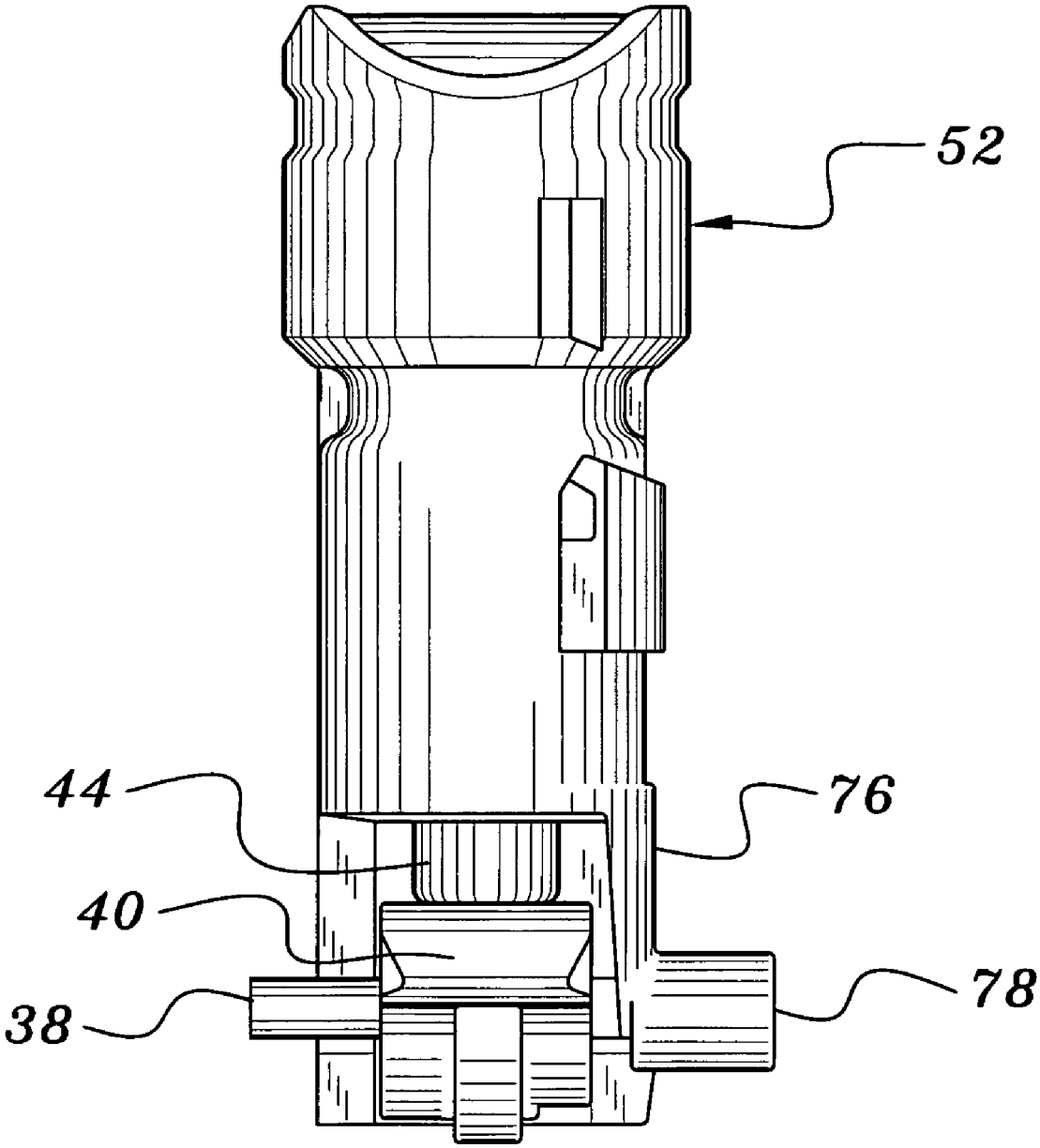
FIG. 10B is a right side view thereof.
Figure 10C:
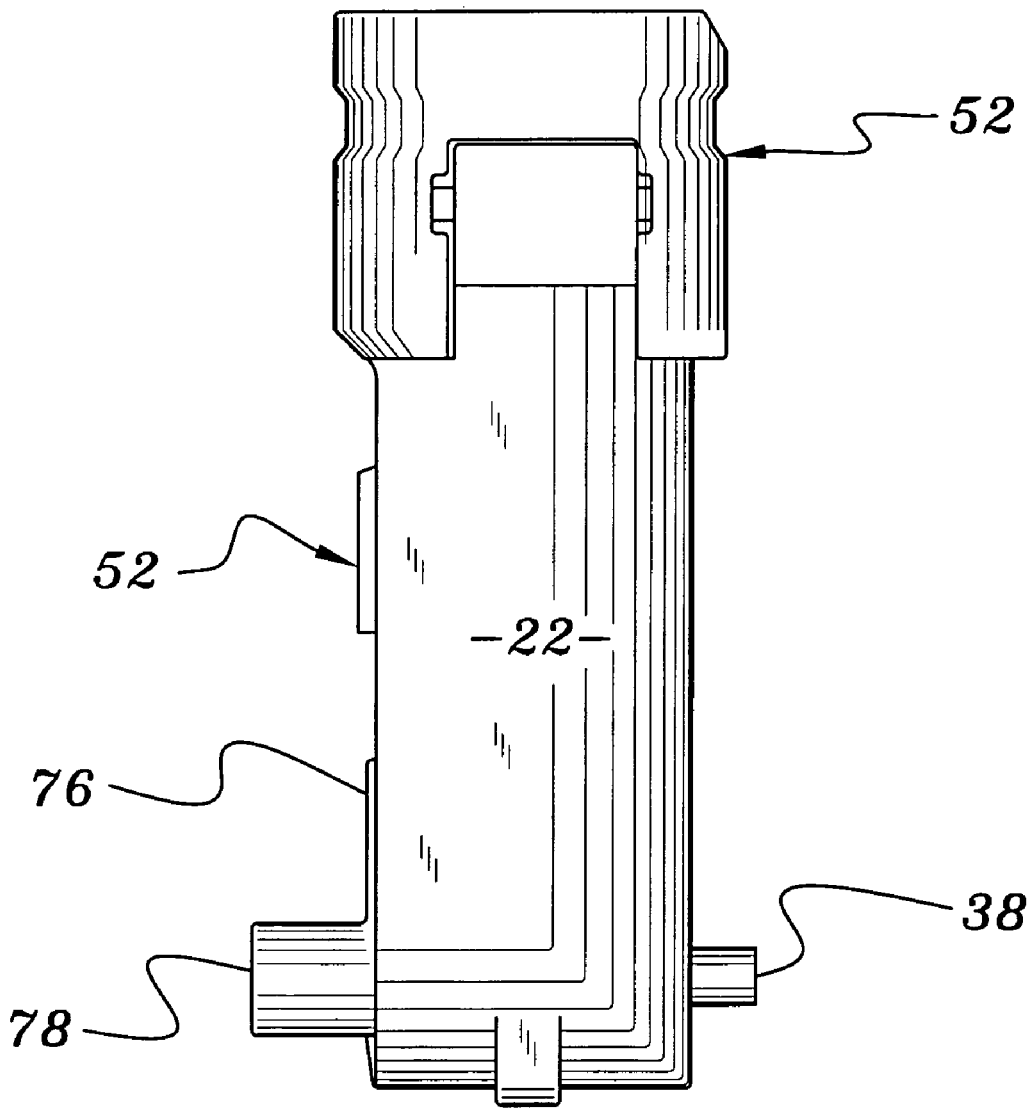
FIG. 10C is a left side view thereof.
Figure 10D:
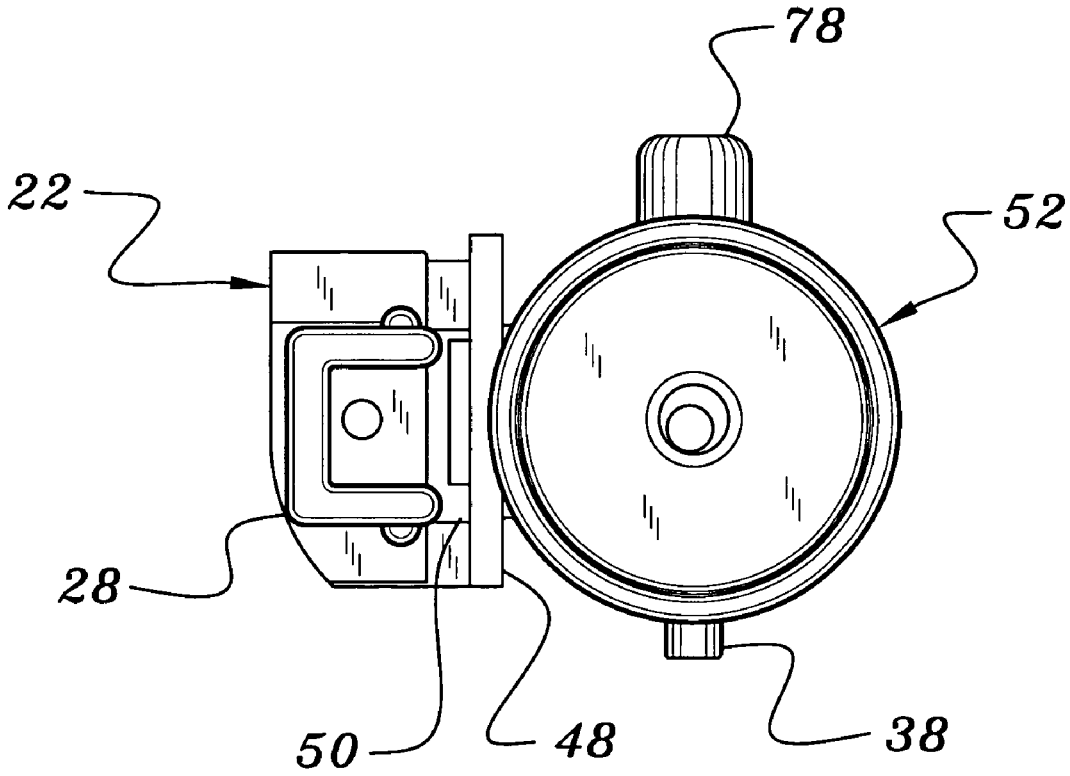
FIG. 10D is a top view thereof.
Figure 10E:
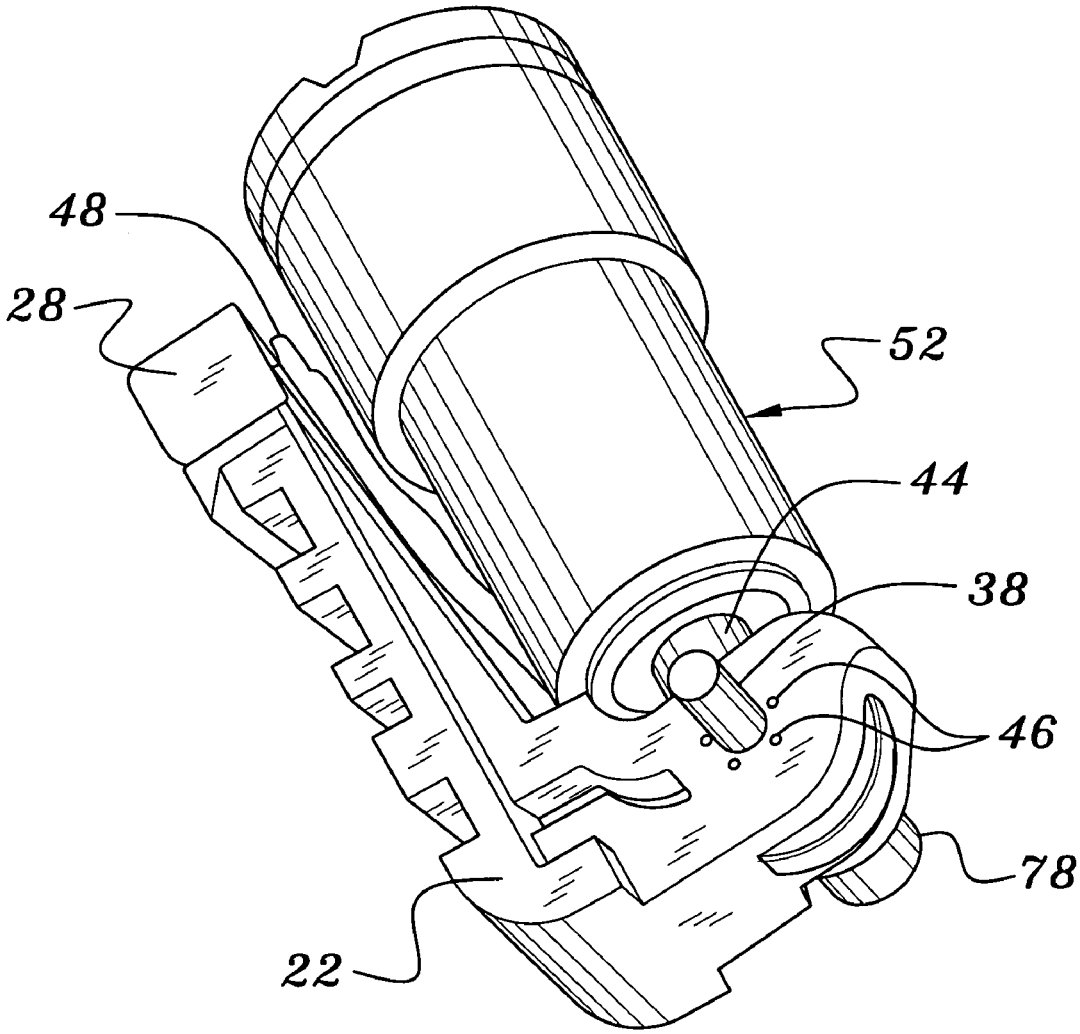
FIG. 10E is a perspective view thereof.
Figure 11A:
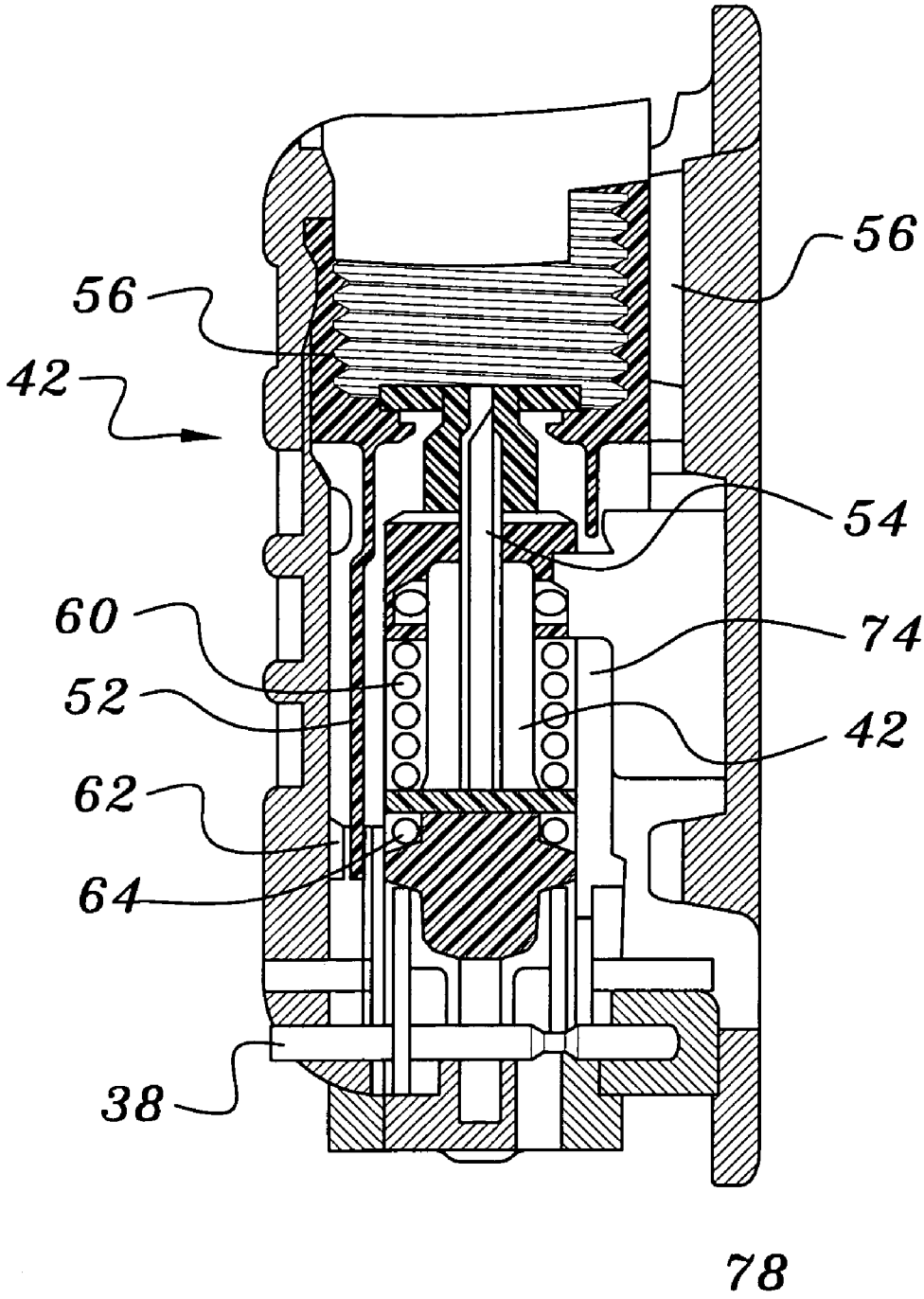
FIG. 11A is a cross-sectional view of FIG. 10B along lines 11A-11A with the firing lever removed for clarity.
Figure 11B:
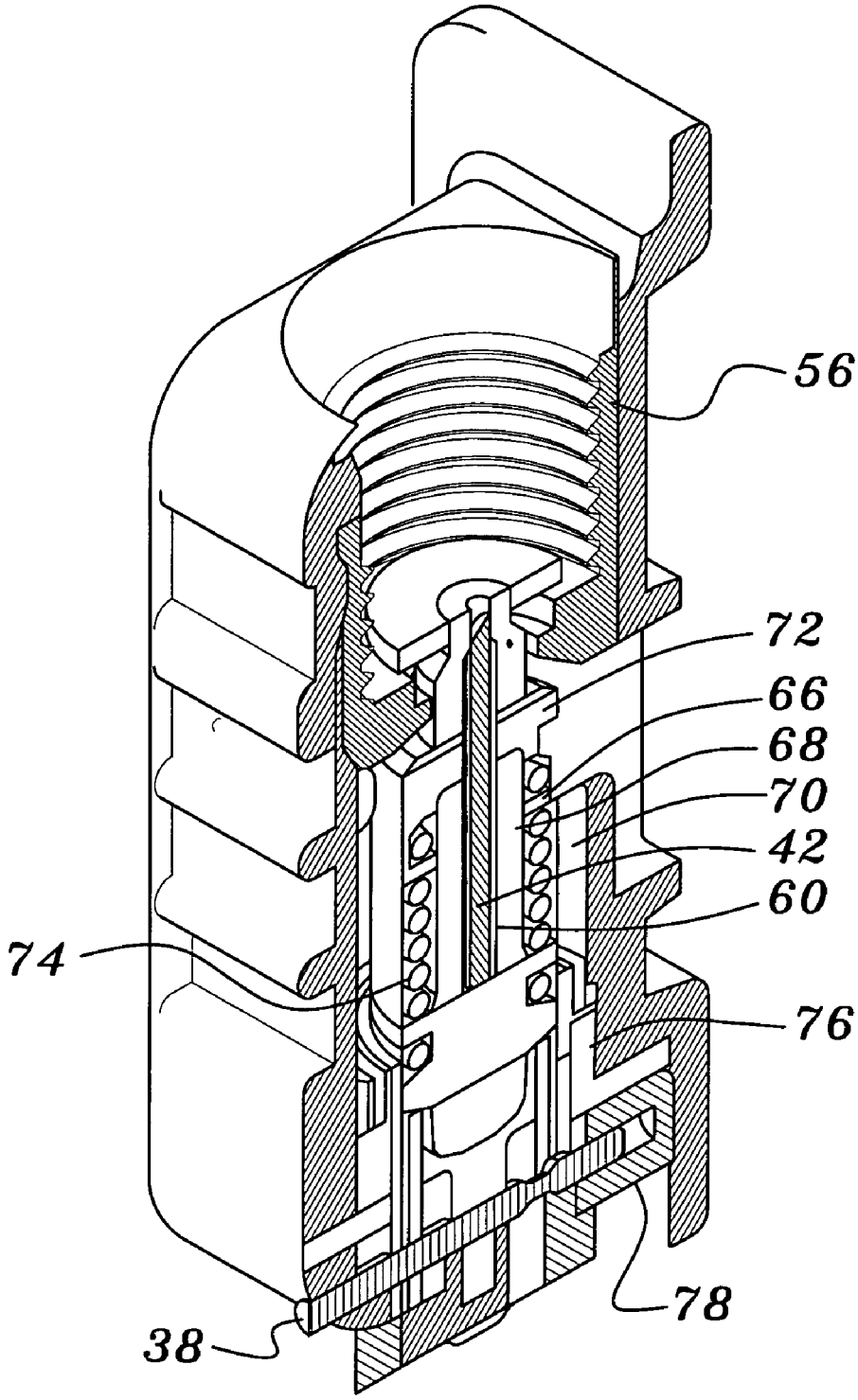
FIG. 11B is a perspective view of FIG. 11A.
Figure 12A:
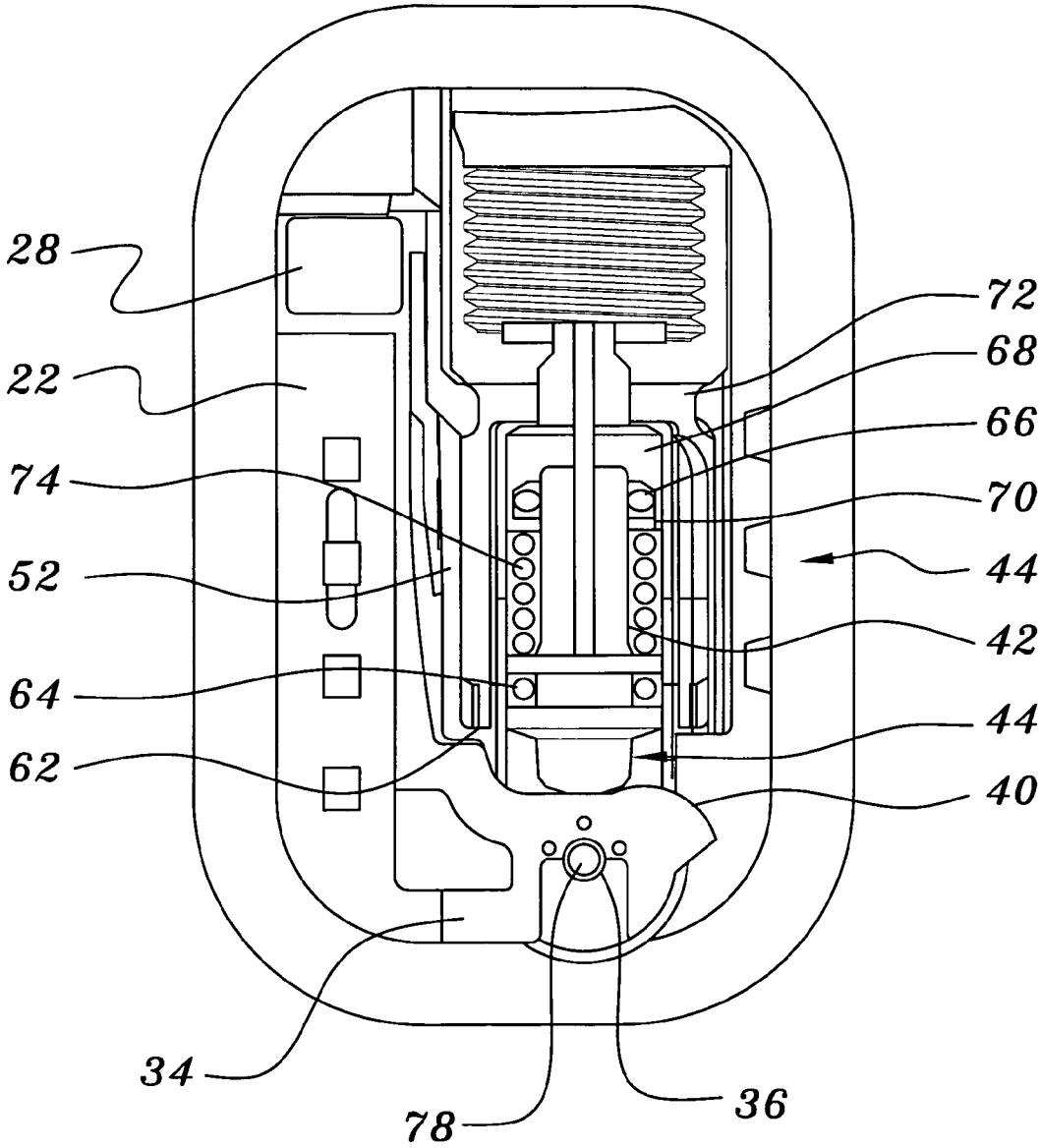
FIG. 12A is a cross-sectional view of FIG. 10A along lines 12A-12A.
Figure 12B:
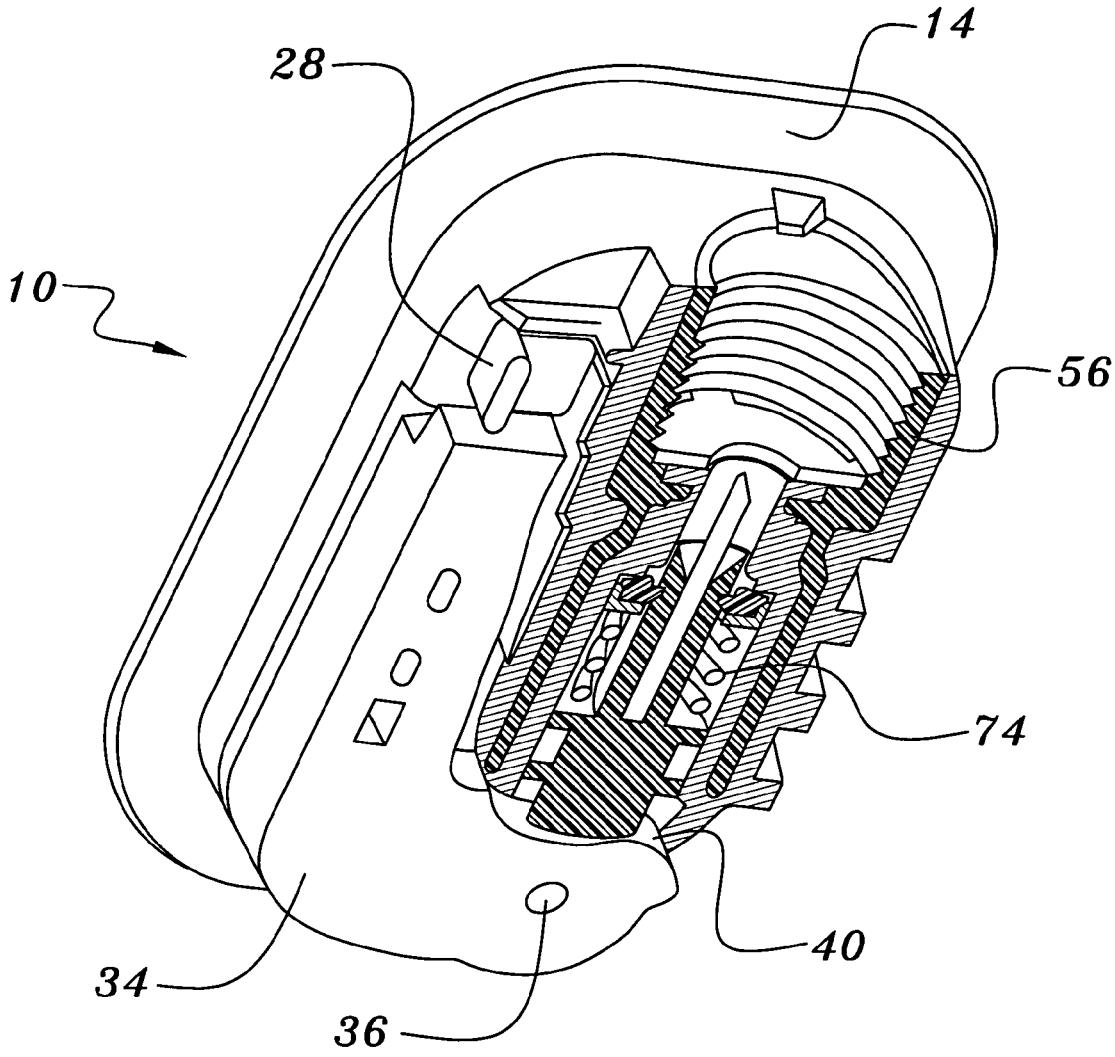
FIG. 12B is a perspective view thereof.

The firing lever 22 is shown in FIGS. 8A, 8B and 8C and generally comprises an L-shaped configuration having an upstanding arm 32 to which the lanyard 26 is inserted into and tightly and permanently secured such as by staking. The lower leg portion 34 of the firing lever 22 comprises a pivot hole 36 through which a pivot pin 38 is inserted and a cammed surface 40 which is operatively designed to cam against the actuator pin 42 of the pierce pin assembly 44 described hereinafter in more detail. To reduce friction, the pivot hole may be a plurality of upstanding protrusions 36A encircling the pivot hole 36.

FIGS. 9A-9E illustrate the housing 12 of the invention with all of the other components removed. Correspondingly, FIGS. 10A-10E illustrate the other components that are assembled within the housing 12 of FIG. 9. These other components shown in FIG. 10 include the firing lever 22 and the safety clip 28 as previously described above and a safety flag 48, preferably colored red, that is snap-fitted between ridges 50 formed in the housing 12. The safety flag 48 is hidden behind the firing lever 22 when the firing lever 22 is in its unactuated/unfired condition. Conversely, the flag 48 is exposed when the firing lever 22 is actuated, thereby indicating a fired condition.

As best shown in FIGS. 11A and 11B and 12A and 12B, a generally cylindrical sleeve 52 is molded in-situ with the housing 12. The cylindrical sleeve 52 comprises at its upper portion 42 a threaded bore 56 for receiving the threaded neck of the gas cylinder 20.

As best shown in FIGS. 11A and 11B and 12A and 12B, the pierce pin assembly 44 is reciprocatably positioned within a longitudinal bore 60 of the housing 12. The pierce pin assembly 44 comprises an actuator pin 42 with a firing pin 54 staked therein for piercing the frangible seal of the gas cartridge 20 when actuated. The actuator pin 42 comprises an O-ring groove 62 at its lower end for receiving a conventional O-ring 64. The O-ring 64 prevents air flowing from the gas cartridge 20 from escaping from the longitudinal bore 60 such that it is directed to exit the housing 12 via exhaust port 18 to flow into and inflate the inflatable.

It is noted that once the gas cartridge 20 is removed, an air may simply escape from inflated inflatable path in the reverse direction. In order to prevent deflation of the inflatable once the gas cartridge 20 is removed, a check valve is employed. The preferred embodiment of the check valve best illustrated in FIGS. 11A and 11B comprises a seat assembly 66 that is reciprocally and sealingly positioned over the actuator pin 42. The seat assembly 66 comprises an annular seal 68 positioned within a retainer clip 70 for support. The annular seal 68 functions to seal against the opening 72 in the bore 60 leading into the threaded bore 56 and against the outer cylindrical surface of the actuator pin 42. A spring 74 is positioned between the seat assembly 66 and the O-ring groove 62 to urge the seal 68 into sealing engagement with the opening 72 and to allow the seat assembly 66 to blow back by the force of the escaping gas from the cartridge 20 upon firing. The spring 74 also functions to return the seat assembly 66 to its sealing engagement with the opening 72 after the gas has escaped, thereby preventing leakage of the inflated inflatable in the event the gas cartridge 20 is removed.

Another embodiment of the check valve is illustrated in FIG. 11C and comprises a flapper valve 68A that secured over the exhaust port 18 by a fastener 69. The flapper valve is composed of a sealing material that forms a seal with the exhaust port 18 when the inflatable is inflated, thereby allowing the gas cartridge 20 to be removed without deflation of the inflatable.

Still another embodiment of the check valve is illustrated in FIG. 11D and comprises an annular seal 68B centered within a retainer ring 70A for support. The annular seal 68B functions to seal against the exhaust port 18. A spring 74B is positioned between the retainer ring 70A and an annular mounting ring 70A secured to the housing 12 to urge annular seal 68B into sealing engagement with the exhaust port 18 and to allow annular seal 68B to blow back by the force of the escaping gas from the cartridge 20 upon firing. The spring 74B also functions to return the annular seal 68B to its sealing engagement with the exhaust port 18 after the gas has escaped, thereby preventing leakage of the inflated inflatable in the event the gas cartridge 20 is removed.

It is noted that as shown in FIGS. 11C and 11D, the pierce pin 54 may comprise a central passageway that allows the flow of gas through the pierce pin 54 and the actuator pin 42 to exit therefrom proximate to the exhaust port 18. However, when using the pierce pin assembly 44 of the preferred embodiment, the pierce pin 54 may simply be fluted as shown in the other figures whereupon the escaping gas simply flows through the flute on the pierce pin 54 to blow back the seat assembly 66, then around the actuator pin 42 to exit the exhaust port 18.

An important feature of the present invention is the use of the cylindrical sleeve 52 of FIG. 10 in combination with the housing of FIG. 9. Specifically, as noted above, the material constituting the housing 12 should be of a softer material that is heat sealable with conventional articles to be inflated. In contrast, the material constituting the cylindrical sleeve 52 may be of a significantly harder, high-strength, material such as glass-filled nylon and having a tensile strength of about 30,000 psi. According to the invention, the cylindrical sleeve 52 is injection molded in a first step and then the housing 12 is injection molded about the sleeve 52 in a second injection molding step. These two steps may occur with the cylindrical sleeve 52 being insert-molded or with the cylindrical sleeve 52 being formed in-situ in a two-step molding process as more particularly set forth in our concurrently-filed patent application directed to the same and incorporated by reference herein.

Since the material constituting the cylindrical sleeve 52 is composed of a much stronger material than that of the housing 12, it should be appreciated that it can better withstand the significant pressures that occur immediately upon actuation when gas is rapidly flowing from the gas cartridge 20 through the housing 12 into the inflatable article. Indeed, the use of the cylindrical sleeve 52 in the structure provides the needed strength to withstand the force of the rapidly-flowing gas from the cartridge. Yet, the gas contacts only the housing 12 and no portion of the sleeve 52. The likelihood of separation between the materials is therefore essentially eliminated since the gas flows directly into the article being inflated without contacting the bond formed between the materials constituting the sleeve 52 and the housing 12.

Another significant advantage achieved by utilizing the cylindrical sleeve 52 as described above is the ability to incorporate a depending skirt portion 76 therefrom which forms a socket 78 with a blind hole for receiving the pivot pin 38. Specifically, the socket 78 depending from the skirt 76 is embedded within the housing 12 during the two-step injection process. Consequently, during assembly, the pivot pin 38 may be easily inserted therein without having to pre-drill a hole as in the case of my prior patent, U.S. Pat. No. 5,564,478. The elimination of any need for pre-drilling significantly reduces manufacturing and assembly costs. A more detailed description of the manufacturing apparatus and method for forming the blind hole is set forth in our concurrently-filed application noted above that is hereby incorporated by reference herein.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A heat sealable inflator for heat sealing to an inflatable article, comprising in combination:

a housing having an integral peripheral flange and a longitudinal bore;

a sleeve molded in-situ with the housing, said sleeve including an exposed upper portion adapted to receive the neck of a gas cartridge and an embedded lower portion molded in situ within the housing about the longitudinal bore to provide strength thereto;

a pierce pin assembly reciprocatably positioned within the longitudinal bore supported by said lower portion of the sleeve to pierce a frangible seal of the gas cartridge whereupon release of the gas therefrom, the gas may flow through the inflator and then out an exhaust port of the inflator into the inflatable article without contacting said embedded lower portion of the sleeve.

2. The heat sealable inflator as set forth in claim 1, wherein said pierce pin assembly comprises an actuator pin with a firing pin for piercing the frangible seal of the gas cartridge when actuated.

3. The heat sealable inflator as set forth in claim 2, further including a seat assembly reciprocably and sealingly positioned over the actuator pin that allows the flow of air from the gas cartridge and checks the flow of air in a reverse direction.

4. The heat sealable inflator as set forth in claim 3, wherein said seat assembly comprises an annular seal positioned within a retainer clip for support that functions to seal against an opening leading into the gas cylinder and against the outer cylindrical surface of the actuator pin.

5. The heat sealable inflator as set forth in claim 4, further including a spring to urge said annular seal into sealing engagement with said opening and to allow said seat assembly to blow back by the force of the escaping gas from the gas cartridge upon firing and to return said seat assembly to its sealing engagement with said opening after the gas has escaped, thereby preventing leakage of the inflatable article in the event the gas cartridge is removed.

6. A heat sealable inflator for heat sealing to an inflatable article, comprising in combination:

a housing having an integral peripheral flange;

a sleeve molded in-situ with the housing, said sleeve including an exposed upper portion adapted to receive the neck of a gas cartridge and an embedded lower portion molded in situ within the housing about the longitudinal bore to provide strength thereto;

a pierce pin assembly reciprocatably positioned within said sleeve to pierce a frangible seal of the gas cartridge whereupon release of the gas therefrom, the gas may flow through the inflator and then out an exhaust port of the inflator into the inflatable article, said pierce pin assembly comprising an actuator pin with a firing pin for piercing the frangible seal of the gas cartridge when actuated; and a check valve positioned over said exhaust port that allows the flow of air from the gas cartridge through the exhaust port and checks the flow of air in a reverse direction.

7. The heat sealable inflator as set forth in claim 6, wherein said check valve comprises a flapper valve.

8. The heat sealable inflator as set forth in claim 6, wherein said check valve comprises a spring-loaded seal.

9. The heat sealable inflator as set forth in claim 1, wherein a material constituting said housing with its flange is composed of a heat sealable material that may be heat sealed to the inflatable article.

10. The heat sealable inflator as set forth in claim 9, wherein said material constituting said housing with its flange includes a hardness in the range of 40 to 90 on the durometer scale Shore D.

11. The heat sealable inflator as set forth in claim 10, wherein said material constituting said housing with its flange includes a tensile strength of about 5800 psi.

12. The heat sealable inflator as set forth in claim 11, wherein a material constituting said cylindrical sleeve is significantly harder that said material constituting said housing.

13. The heat sealable inflator as set forth in claim 12, wherein said material constituting said cylindrical sleeve includes a tensile strength of about 30,000 psi.

14. The heat sealable inflator as set forth in claim 1, further comprising a firing lever to which is tethered a jerk handle by a lanyard.

15. The heat sealable inflator as set forth in claim 14, wherein said firing lever comprises an L-shaped configuration having an upstanding arm to which said the lanyard is secured and a lower leg portion including a pivot hole and a cammed surface which operatively cams against said actuator pin of said the pierce pin assembly as the firing lever rotates on a pivot pin inserted within said pivot hole.

16. The heat sealable inflator as set forth in claim 15, further including a plurality of upstanding protrusions encircling said pivot hole to reduce friction.

17. The heat sealable inflator as set forth in claim 1, wherein said sleeve is injection molded in a first step and then said housing is injection molded about said sleeve in a second injection molding step.

18. The heat sealable inflator as set forth in claim 17, wherein said sleeve includes a depending skirt portion which forms a socket with a blind hole.

19. The heat sealable inflator as set forth in claim 18, wherein said socket depending from said skirt is embedded within said housing during the two-step injection process and is blocked-off during injection molding such that a blind hole is thus formed for receiving said pivot pin.

20. The heat sealable inflator as set forth in claim 1, further including an indicator that is visible when the inflator has already been fired.

* * * * *